US006601317B2

(12) United States Patent
Nardi

(10) Patent No.: US 6,601,317 B2
(45) Date of Patent: Aug. 5, 2003

(54) HIGH-EFFICIENCY DRYING KILN PARTICULARLY FOR WOOD-LIKE MATERIAL

(75) Inventor: Renzo Nardi, S. Bonifacio (IT)

(73) Assignee: Nardi S.p.A., Soave (IT)

( * ) Notice: Subject to any disclaimer, the term of this patent is extended or adjusted under 35 U.S.C. 154(b) by 0 days.

(21) Appl. No.: 09/853,752

(22) Filed: May 14, 2001

(65) Prior Publication Data

US 2002/0121028 A1 Sep. 5, 2002

(30) Foreign Application Priority Data

Mar. 2, 2001 (IT) ..... VR010013 U

(51) Int. Cl.[7] ..... F26B 19/00; F26B 25/06

(52) U.S. Cl. ..... 34/231; 34/212; 34/215; 34/223; 34/225

(58) Field of Search ..... 34/201, 202, 215, 34/212, 219, 223, 224, 225, 231, 232

(56) References Cited

U.S. PATENT DOCUMENTS 4,955,146 A * 9/1990 Bollinger ..... 34/191
5,992,048 A * 11/1999 DeVore et al. ..... 34/522

* cited by examiner

*Primary Examiner*—Pamela Wilson
(74) *Attorney, Agent, or Firm*—Guido Modiano; Albert Josif; Daniel O'Byrne

(57) ABSTRACT

A high-efficiency drying kiln, particularly for wood-like material, constituted by an internal chamber, which is covered with thermally insulating material and is provided with at least one opening for loading and extracting the material to be treated; two flues for recirculation of the air inside the chamber by aspirating and delivering air respectively from and into the outside environment; an air heating device; an air acceleration duct and air acceleration elements located inside the acceleration duct; the air acceleration duct has, at least at its output section, elements for orienting in an axial direction the air stream that is forced by the acceleration elements.

19 Claims, 2 Drawing Sheets

HIGH-EFFICIENCY DRYING KILN PARTICULARLY FOR WOOD-LIKE MATERIAL

BACKGROUND OF THE INVENTION

The present invention relates to a high-efficiency drying kiln, particularly for wood-like material, such as for example boards, panels, laths, et cetera.

It is known that a drying kiln for wood-like material comprises a supporting frame being covered with thermally insulated walls which delimit one or more chambers inside which the material to be dried is loaded. Such chambers are crossed by hot air which is propelled with a low head by blowers or fans.

A drawback of the drying kilns currently in use is that the blowers or fans being used generate a turbulent air flow which causes uneven velocity distribution of the air inside the kiln.

The nonuniformity of the air stream entails poor operation of the kiln, because the drying process does not occur evenly and uniformly on all the stacks of wood contained in the treatment chamber.

In particular, the drying of wood-like material can take even longer than a month, during which the kiln works uninterruptedly. Accordingly, it is evident why all the refinements aimed at reducing consumption and increasing the effectiveness of the heat exchange with the air can have a decisive effect on the total production costs of the products being treated.

SUMMARY OF THE INVENTION

The aim of the present invention is to provide a drying kiln in which the turbulences and nonuniformities of the distribution of the air that leaves the fans are reduced, so that each individual stack of wood-like material contained in the kiln is hit by the same amount of air, regardless of its position, in order to ensure a uniform and homogeneous drying process of the entire load of the kiln, thereby allowing to treat simultaneously rather large batches of stacks of wooden material.

Another object of the present invention is to provide a high-efficiency drying kiln which can operate with minimal consumption while maintaining a high heat exchange coefficient, in order to reduce the production costs related to the amount of fuel and electric power used per unit of treated material.

Another object of the present invention is to provide a drying kiln in which the hot air is changed and mixed continuously so as to achieve good recirculation on the material to be dried.

Not the least object of the present invention is to provide a drying kiln which can be manufactured easily and therefore has low manufacturing costs, so that its industrialization also is economically advantageous.

This aim and these and other objects which will become better apparent hereinafter are achieved by a high-efficiency drying kiln, particularly for wood-like material, which comprises:

- at least one internal chamber, being covered with thermally insulating material and provided with at least one opening for loading and extracting a material to be treated,
- at least two flues for recirculation of air inside said chamber by aspirating and delivering air respectively from and into the outside environment,

- at least one air heating device,
- at least one air acceleration duct, and
- air acceleration means located inside said acceleration duct,
- and characterized in that said air acceleration duct has, at least at an output section thereof, means for orienting in an axial direction an air stream that is forced by said acceleration means.

Conveniently, the air acceleration duct is arranged at the centerline and at the top of said internal chamber.

Advantageously, the kiln comprises an air channeling panel at least at an output end of the acceleration duct and externally thereto.

BRIEF DESCRIPTION OF THE DRAWINGS

Further characteristics and advantages of the present invention will become better apparent from the description of an embodiment thereof, illustrated only by way of non-limitative example in the accompanying drawings, wherein.

In the accompanying drawings, identical or similar parts or components have been designated by the same reference numerals.

DESCRIPTION OF THE PREFERRED EMBODIMENTS

Figure 1:
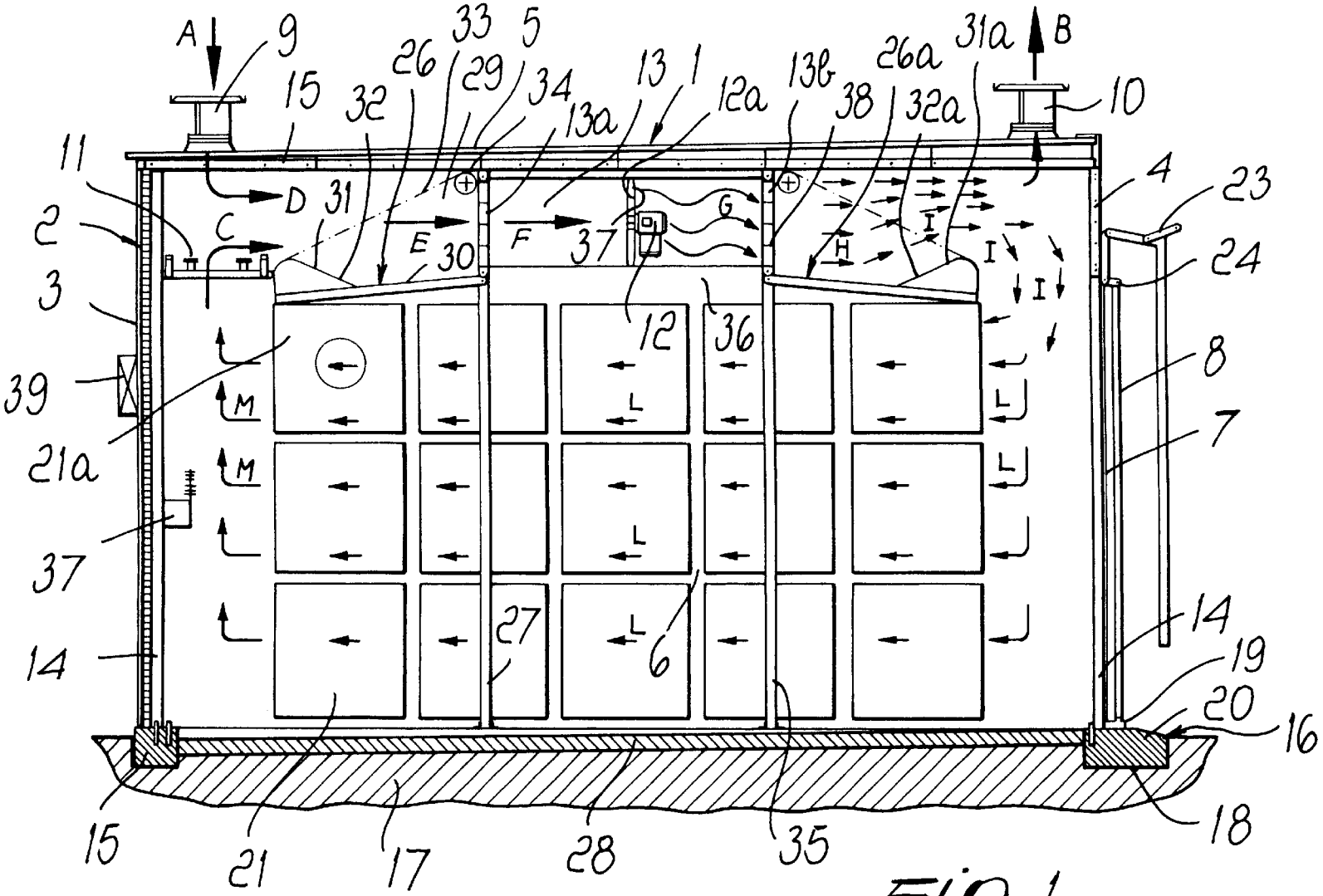
FIG. 1 is a sectional view, taken along a longitudinal plane, of a kiln according to the invention.
Figure 2:
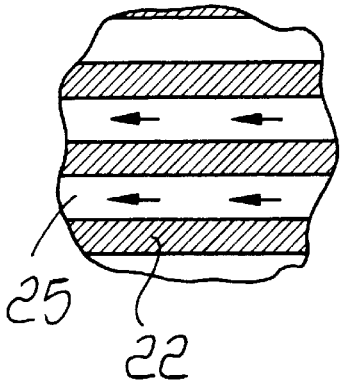
FIG. 2 is an enlarged-scale side view of a detail of FIG. 1.

With reference to FIGS. 1 and 2, 1 generally designates a drying kiln according to the invention, which comprises:

- a supporting frame 2 for side walls 3 and 4 and a ceiling 5 which are thermally insulated,
- at least one internal chamber 6, which is delimited by the walls 3 and 4 and by the ceiling 5,
- at least one opening 7 for loading and removing the material to be treated,
- one or more doors 8 for closing the opening or openings 7,
- two flues 9 and 10 for drawing ambient air from outside and for discharging recirculation air externally,
- a heater 11 for the aspirated air,
- air acceleration means 12, which are contained in an acceleration duct 13 being fixed to the ceiling 5 and at the centerline of the kiln 1.

The frame 2 has uprights 14, at the top of which beams 15 can be fixed; the uprights and the beams are relatively closely spaced, so as to constitute a lattice for supporting the walls 3 and 4 and the ceiling 5. The lower end of each upright 14 is embedded in a respective plinth 15 or 16 which is fixed in the ground 17. The plinths 16 that lie close to the opening or openings 7 have a larger lower resting surface 18 and an upper surface 19 mostly affected by a chute 20 which descends toward the outside of the kiln 1 and is adapted to facilitate the operations for loading and removing the material to be treated.

The material to be treated is usually constituted by stacks 21 of wooden boards 22 (FIG. 2) which are arranged in an orderly fashion and are inserted in the chamber 6 of the kiln 1 through the opening 7, after opening the door 8. The door 8 can be moved by a known lever device 23 and the edges 24 thereof are provided with gaskets to ensure tightness against escape of hot air from the inside as well to achieve good thermal insulation of the chamber 6.

As clearly shown by FIG. 2, the wooden boards 22 are stacked on each other so as to leave gaps 25 which are adapted for the passage of the hot air that arrives from the top of the chamber 6 of the kiln 1.

The flues 9 and 10 affect the perimetric part of the ceiling 5 and are adapted to operate alternatively for aspirating and for expelling air. In the illustrated example, the flue 9 is crossed by a stream of suction air, designated by the letter "A", while the flue 10 is crossed by a stream of air directed along the arrow "B" and discharged outside the chamber 6.

Heat exchange batteries 11 are arranged under the intake flue 9 and are adapted to heat the air that passes through them according to the flow "C". Downstream of the batteries 11, the hot air that arrives from the chamber 6 mixes with the flow of ambient air "D" that arrives from the intake flue 9 and then continues in the direction "E".

In order to convey the stream "E" with minimal load losses and achieve good fluid mixing, a panel 26 is provided which can be hinged to at least one pair of internal uprights 27. The panel 26 is fixed proximate to the heater 11 and is arranged so as to delimit, together with the ceiling 5, a channel 29 for the forced passage of the air.

Advantageously, the panel 26 has, at its free end proximate to the heater 11 and on its face 30 directed toward the ceiling 5, means 31 for diverting and controlling the air stream, which is shaped for example like a spoiler and is designed to divert the air stream so as to reduce the presence of accidental vortices or air pockets, which would lead to load losses and nonuniformities in the air stream. The cross-section of the spoiler 31 is shaped like a convex half ogive, with an outer surface 32 which descends, in use, in the air advancement direction. The end of at least one cable 33 is rigidly coupled to the free end of the panel 26, at the spoiler 32, and its other end can be wound, for a significant extent, on a roll 34 which can be fixed to the ceiling 5 proximate to the upper end of the internal uprights 27.

A duct 13 can be rigidly coupled to the pairs of internal uprights 27 and 35 and/or to the ceiling 5, a fan or blower 12 being accommodated therein.

A second panel 26*a* is further fixed to the internal uprights 35, downstream of the duct 13.

The panel 26*a* is fully similar to the above panel 26 and protrudes externally with respect to the space 36 delimited by the pairs of internal uprights 27 and 35. The cross-section of the spoiler 31*a* of the panel 26*a* also is shaped like a convex half ogive, with an outer surface 32*a* ascending in the air advancement direction.

The blower 12 is adapted to produce negative pressure on the air intake side, in order to draw the air into the duct 13 in the direction indicated by the arrow "F" and to give it a certain head in the direction indicated by the arrows "G".

Figure 3:
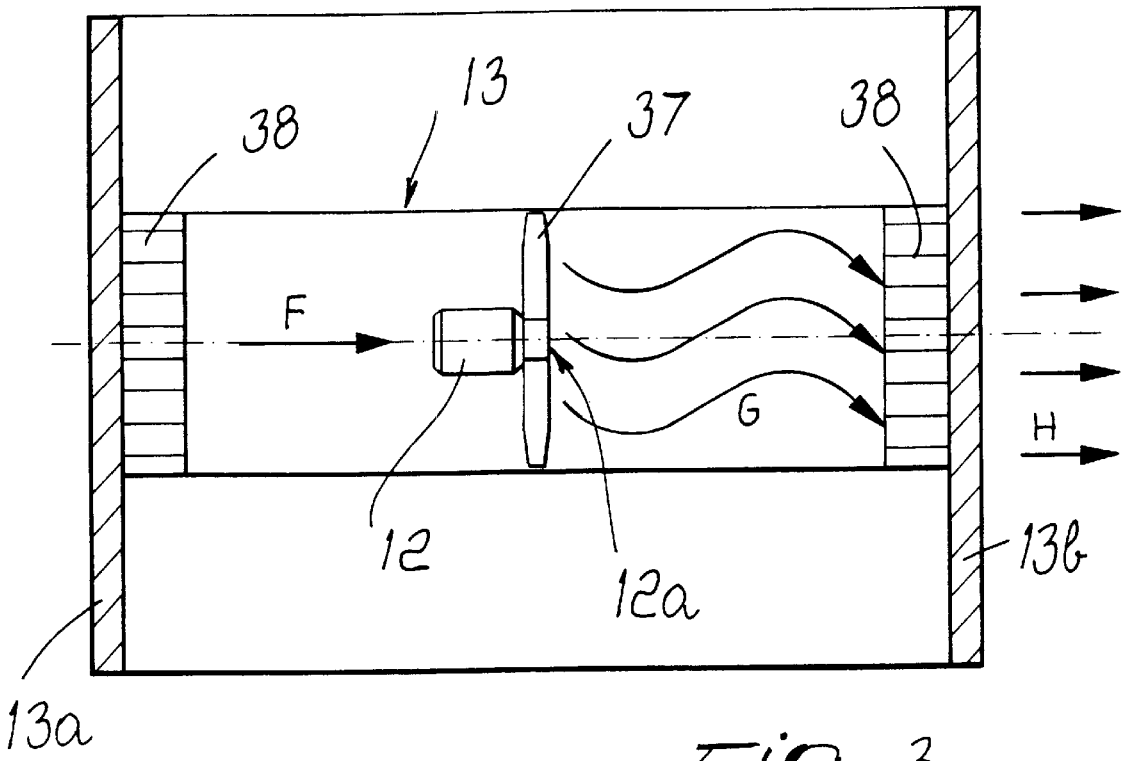
FIG. 3 is a plan view of the air acceleration duct, provided with flow straightening blades.

As shown in FIG. 3, the air stream generated, in use, by the vanes 37 of the impeller 12 is turbulent, as shown by the air streams downstream of the blower 12, which follow helical lines, designated by the arrows "G".

The turbulences generated by the blower 12 downstream of the duct 13 create, inside the chamber 6, an uneven distribution of the air velocity through the stacks 21, forming regions in which heat exchange between the air and the wooden boards 22 is high and therefore the drying process is relatively rapid, and regions where instead the exchange of heat is almost nil and therefore drying is very slow.

Figure 4:
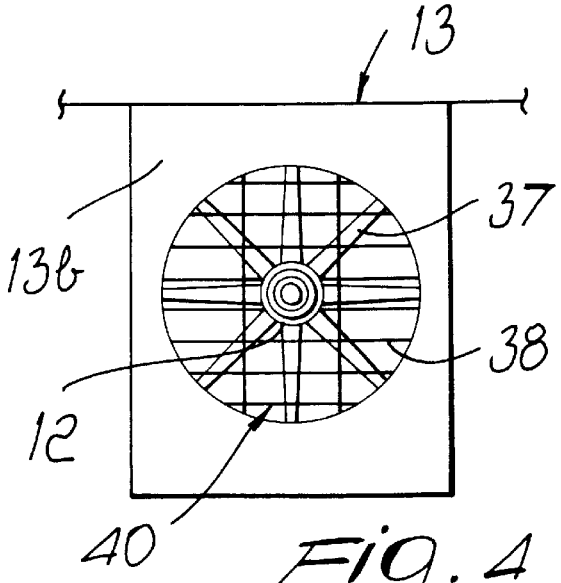
FIG. 4 is a front view of the duct of FIG. 3.

In order to obviate this drawback, upstream and downstream of the blower 12, at the ends 13*a* and 13*b* of the duct 13, multiple fins 38 are provided which are arranged for example in a grille-like pattern 40, as shown in FIG. 4, and the function whereof is to divide the turbulent flow of the air into a plurality of laminar portions being parallel to the axial direction, so as to render the air flow uniform and homogeneous, as indicated by the arrows "H".

The laminar air flow "H" leaving the duct 13 undergoes another deflection caused by the presence of the spoiler 31*a*, which produces a reduction in the passage section between the panel 26*a* and the ceiling 5. In this way, the fluid vein is thus diverted upward, as shown by the arrows "I" is in FIG. 1, and is conveyed uniformly throughout the entire chamber 6, thus ensuring minimal load losses.

Most of the hot air in fact advances uniformly, in the directions indicated by the arrows "I", toward the internal chamber 6 thanks to the head acquired from the blower 12 and to the corrective and orienting effect of the fins 38 and of the spoiler 31*a*.

A minimal but constant amount of air is instead directed toward the discharge flue 10 and then aspirated by the external negative pressure in the direction indicated by the arrow "B", thus achieving a continuous exchange of fluid with the outside environment.

While proceeding downwards, the air is forced to flow toward the stacks 21 of wooden boards 22 placed in the central part of the chamber 6 of the kiln 1 and to pass through the gaps 25 along the directions indicated by the arrows "L". Once the air has passed through all of the stacks 21, since it cannot rise in the meantime toward the top of the chamber 6 due to the obstruction caused by the presence of the boards 22, the air rises, proximate to the wall 3 that lies opposite the wall 4 affected by the opening 7, due to the negative pressure produced by the fan 12 along the direction of flow designated by "M", then passes through the heat exchange batteries 11 and mixes with fresh air which arrives from the suction flue 9, thus completing its working cycle.

At least one wall, for example wall 3, is usually provided with a temperature sensor 37 which, if the kiln 1 is manually adjustable, visualizes externally the temperature of the chamber 6 so as to allow to intervene in order to perform appropriate adjustments.

If instead the kiln 1 is adjustable with the aid of an electronic control unit 39, such control unit automatically performs the necessary adjustments, following the setting of predefined parameters.

Each roller 34 on which the respective cable 33 can wind can be of the freely rotating type; in this case, the partition 26 or 26*a* is left free to rest on the upper stacks 21*a*, and this condition allows automatic adjustment of the inclination of the partitions 26 and 26*a*, since as the degree of drying increases, the stacks 21*a* contract, causing a lowering of the partitions 26 and 26*a*. Alternatively, the rollers 34 can be motorized; this solution can be advantageously combined with automatic operation of the kiln 1 by using the electronic control unit 39, and in this case their position is adjusted according to the setting of predefined parameters, without the intervention of an operator.

The direction in which the air flows can be reversed with a timing which can be defined according to the type of treatment. To this end, it is sufficient to change the direction of rotation of the impeller 12*a* of the blower 12 or turn it through 180 degrees. The blower 12 is preferably arranged on the centerline of the duct 13, but it is also possible to arrange it at its intake end 13*a* or discharge end 13*b*.

During the reversal step, nothing changes for the panels 26 and 26*a*, in view of their symmetrical arrangement with respect to the duct 13, and for the flues 9 and 10, which are perfectly equivalent.

In order to achieve maximum reversibility in operation, it is further possible to have another series of heat exchange batteries 11 downstream of the duct 13 and proximate to the opening 7 and to have a ceiling 5 which can be inclined on the opposite side with respect to that defined earlier.

It is evident that a high-efficiency drying kiln 1 particularly suitable for wood-like material, provided with grilles 40, is capable of ensuring uniform distribution of the air inside the chamber 6 and therefore of ensuring a regular execution of the drying process, which ensures uniform treatment of the entire load of the kiln.

A kiln 1 according to the invention is further capable of operating with minimal consumption while maintaining a high heat exchange coefficient, good recirculation of air on the material to be dried, and low noise pollution thanks to the low noise that is generated, in use, by the impeller 12.

The materials and the dimensions may be various according to requirements.

The invention is susceptible of numerous modifications and variations within the scope of the protection defined by the content of the appended claims.

The disclosures in Italian Utility Model Application No. VR2001U000013 from which this application claims priority are incorporated herein by reference.

What is claimed is:

1. A high-efficiency drying kiln comprising:

at least one internal chamber, which is covered with thermally insulating material and is provided with at least one opening for loading and extracting a material to be treated, at least two flues for recirculation of the air inside said chamber by aspirating and delivering air respectively from and into the outside environment, at least one air heating device, at least one air acceleration duct arranged downstream of said air heating device, and air acceleration means located inside said acceleration duct;

wherein said air acceleration duct has, at least at its output section, means for orienting in an axial direction an air stream that is forced by said acceleration means, said orienting means comprising a plurality of fins which are arranged in a grille pattern, so as to split the air stream downstream of said acceleration means into a plurality of parallel laminar portions.

2. The kiln according to claim 1, wherein said at least one air acceleration duct is arranged at a centerline and at the top of said chamber.

3. The kiln according to claim 1, comprising an air channeling panel at least at said output section of said acceleration duct and externally thereto.

4. The kiln according to claim 3, wherein said at least one panel has means for air stream redirection and control inside said chamber.

5. The kiln according to claim 4, wherein said redirection and control means are constituted by a widening of a free end of said panel in the form of a spoiler, having a cross-section shaped like a half ogive convex toward the outside.

6. The kiln according to claim 4, wherein said panel has an end which is hinged to said acceleration duct and another end of said panel which rests, during use, on the material to be dried.

7. The kiln according to claim 5, further comprising means for lifting the free end of said panel.

8. The kiln according to claim 7, wherein said lifting means comprise a cable which can be rigidly coupled to said free end of said panel and can be wound on at least one roller which is mounted on the ceiling of said chamber.

9. The kiln according to claim 8, wherein said roller is motorized.

10. The kiln according to claim 1, further comprising a sensor for detecting the temperature of the air inside said chamber in order to control said air heating device.

11. The kiln according to claim 10, wherein said temperature sensor, said air heating device and said air acceleration means are connected to an electronic control unit.

12. The kiln according to claim 1, further comprising means for lifting the free end of said panel.

13. The kiln according to claim 12, wherein said lifting means comprise a cable which can be rigidly coupled to said free end of said panel and can be wound on at least one roller which is mounted on the ceiling of said chamber.

14. The kiln according to claim 13, wherein said roller is motorized.

15. A high-efficiency drying kiln comprising:

at least one internal chamber, which is covered with thermally insulating material and is provided with at least one opening for loading and extracting a material to be treated, at least two flues for recirculation of the air inside said chamber by aspirating and delivering air respectively from and into the outside environment, at least one air heating device;

at least one air acceleration duct;

air acceleration means located inside said acceleration duct;

said air acceleration duct having, at least at its output section, means for orienting in an axial direction an air stream that is forced by said acceleration means;

an air channeling panel arranged at least at said output section of said acceleration duct and externally thereto;

said at least one panel having means for air stream redirection and control inside said chamber;

said redirection and control means comprising a widening of a free end of said panel in the form of a spoiler, having a cross-section shaped like a half ogive convex toward the outside.

16. The kiln according to claim 15, wherein said orienting means comprise a plurality of fins which are arranged in a grille pattern, so as to split the air stream downstream of said acceleration means into a plurality of parallel laminar portions.

17. The kiln according to claim 15, wherein said at least one air acceleration duct is arranged at a centerline and at the top of said chamber.

18. The kiln according to claim 15, wherein said panel has an end which is hinged to said acceleration duct and another end of said panel which rests, during use, on t to be dried.

19. The kiln according to claim 15, further comprising a sensor for detecting the temperature of the air inside said chamber in order to control said air heating device, said temperature sensor, said air heating device and said air acceleration means being connected to an electronic control unit.

* * * * *